United States Patent [19]

Cieslik et al.

[11] Patent Number: 4,856,940

[45] Date of Patent: Aug. 15, 1989

[54] LEMNISCATE MINING SUPPORTS

[75] Inventors: Jerzy Cieslik, Gliwice; Marek Flak, Tarnowskie Gory; Eugeniusz Kuczka, Katowice; Franciszek Oles, Ruda Slaska; Zdsizlaw Marszycki; Kornel Olender, both of Gliwice, all of Poland

[73] Assignee: Gwarectwo Mechanizacji Gornictwa "Polmag" Przedsiebiorstwo Panstwowe Fabryka Zmechanizowanych Obudow Scianowych Fazos, Tranowskie Gory, Poland

[21] Appl. No.: 169,932

[22] Filed: Mar. 18, 1988

[30] Foreign Application Priority Data

Mar. 20, 1987 [PL] Poland ..... 264767

[51] Int. Cl.[4] ..... E21D 23/04

[52] U.S. Cl. ..... 405/296

[58] Field of Search ..... 405/291, 296, 295, 299; 299/31, 33; 248/357

[56] References Cited

U.S. PATENT DOCUMENTS

| | | | |
|---|---|---|---|
| 4,037,419 | 7/1977 | Hill et al. | 405/296 X |
| 4,269,546 | 5/1981 | Saunders | 405/296 |
| 4,708,531 | 11/1987 | Plenter | 405/296 |

FOREIGN PATENT DOCUMENTS

| | | |
|---|---|---|
| 126385 | 10/1985 | Poland . |
| 136909 | 4/1987 | Poland . |

*Primary Examiner*—David H. Corbin

*Attorney, Agent, or Firm*—Ladas & Parry

[57] ABSTRACT

This invention relates to a lemniscate mining support comprising a foot piece, a roof bar, an anti-fall shield connected between the foot piece and the roof bar, and movable props between the roof bar and the foot piece so as to move the roof bar. The joints connecting the anti-fall shield to the foot piece and the anti-fall shield to the roof bar are positioned so that the anti-fall shield can be positioned at a steep angle, relative to the roof bar so that damage to the anti-fall shield can be minimized while allowing the anti-fall shield to contribute to the support of the roof bar.

1 Claim, 2 Drawing Sheets

LEMNISCATE MINING SUPPORTS

Figure 1:
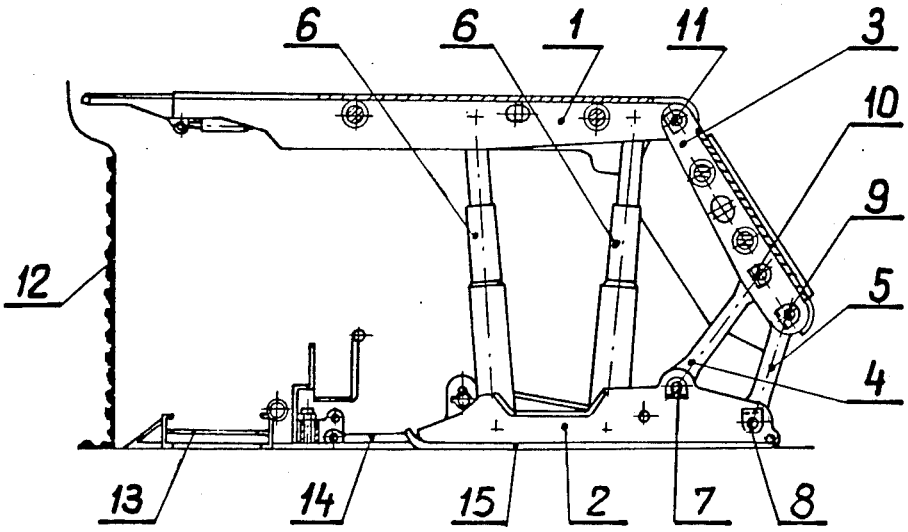

This invention relates to lemniscate mining supports, including a foot piece connected to an anti-fall shield by means of connectors of a lemniscate system, as well as a roof bar supported by props, situated one after another along this roof bar and supported on the said foot piece.

The lemniscate mining supports known form the Polish Patent Specification No. 109,332 has a roof bar supported on two props situated one after another and resting on a foot piece. The said roof bar is connected in the rear part of the rear part of the said foot piece by means of a lemniscate system via an anti-fall shield. The said lemniscate system consists of two pairs of connectors situated one after another and mounted at one end in an articulated way to said foot piece, and at the opposite end, also in an articulated way, to an arm of a straight-line mechanism, the opposite end of the said straight-line mechanism being connected in an articulated way to the said roof bar. The above mentioned arm of the said straigth-line mechanism is most often formed as a ribbed plate, intercepting the pieces of rock from the breaking roof. For this reason, this arm of the straight-line mechanism having the shape of a plate is called anti-fall shield.

In the supports known from the Polish Patent Specification No. 109,332 the articulated joint for connecting the roof bar to the said anti-fall shield is situated within the zone of a straight line situated vertically to the floor and passing through the articulated joint lying closer to the props behind the foot piece. In consequence, the anti-fall shield is situated beyond the zone of the roof bar. The supports known from the Polish Patent Specification No. 126,385 are those of lemniscate type which means that it has an anti-fall shield connected to the foot piece via connectors of a lemniscate type. The ratios of the lengths of the said lemniscate connectors in these supports, as well as the ratios of the distances of the articulated joints of the said connectors in the foot piece and the anti-fall shield, as well as the length of the said anti-fall shield, have been so chosen that during an upward motion of the said roof bar each point of the said roof bar moves along a curve going away from the front of the wall in a way determined by a series of increasing numbers. This proposal has been aimed at ensuring a stable support even if the case of a considerable inclination of the props towards the side wall in spite of a large enough component force directed toward the side wall, produced by the set of the props. The assumed proportions ensure a stable support in the direction of the side wall in the case of a considerable height of the support. Practice has proved proper behaviour of the described supports in the longwalls and their adequate operation under those circumstances within the upper height range.

Supports known from the Polish Patent Specifications Nos. 109,332 and 126,385 used in low beds or during operation in a bed, whose thickness has been considerably decreased, exhibited a drawback consisting in that they are clamped by the rock. In such a case the working surface of the roof bar and the working surface of the anti-fall shield are inclined with respect to each other at an angle equal to approx. 100 degrees, the said shield being only slightly inclined to the foot piece. In such a position, the working surface of the anti-fall shield and the roof bar form together almost one surface. During that time the anti-fall shield begins to act as a roof bar, that is it carries the rock pressure acting on it. In consequence, the support is being clamped between the roof and the floor by the force being the resultant force of the pressure forces of the roof rocks acting on the surface of the roof bar and, in consequence, on the surface of the anti-fall shield. The resultant force of the rock pressure forces acting on the roof bar and the anti-fall shield is so great that it exceeds the maximum force which can be exerted by the props. Finally, the props cannot themselves keep the roof rocks in place and, as a result, these rocks are clamping the support. Shifting of the support which should follow the wall front advance by means of a shifter included in it is very difficult, and sometimes, in extreme cases, entirely impossible.

The aim of this invention is a support which within the whole range of its working heights would not occupy positions in which it could not be easily shifted so as to follow the advance of the wall front. This can be achieved, if the anti-fall shield is short enough and if at each support height being set it occupies a position more vertical than the horizontal one.

The nature of the support according to this invention consists in the assumption of suitable ratios of the lengths of the individual components of lemniscate mechanism.

The ratio of the heights of articulated joints which connect the floor bar with the lemniscate connectors to the distance in the horizontal line between those articulated joints is 1:/2.25 to 2.26, and at the same time, the ratio of the length of the rear connector to the length of the front lemniscate connector is 1:/1.25 to 1.25, the ratio of the distance between the articulated joints which connect the shield with the lemniscate connectors and the square roof of the sum of square of the height and the distance between the articulated joints in the foot piece is 1:/1.75 to 1.76. The length of the anti-fall shield has been so chosen as to ensure such a displacement of the articulated joint which will connect the roof bar to the anti-fall shield in the field between the straight lines $Y_2 = -0.1 \times +h$ and $Y_1 = 0.036 \times 30$ h. The straight lines have been drawn in the xy coordinate system in which the x axis is parallel to the working surface of the foot piece and passes through the articulated joint which combines/connects/ the rear connector to/with/ the sill piece. The Y axis is perpendicular to the x axis and passes through the articulated joint which connects the front connector to the foot piece.

Figure 2:
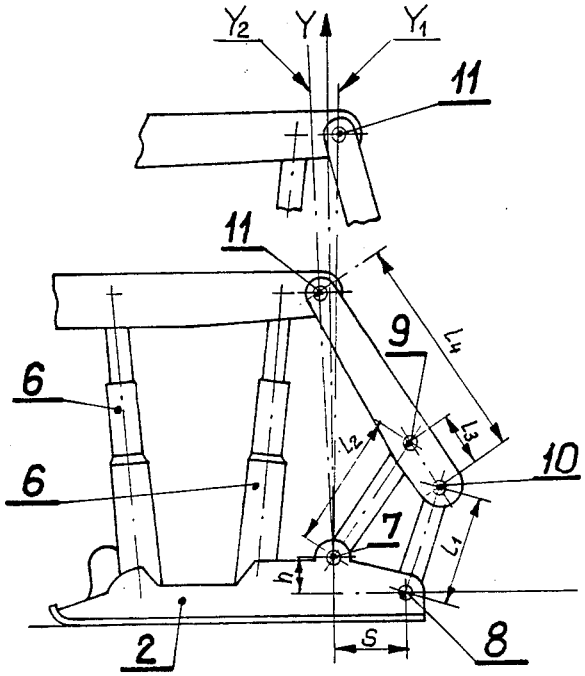

The subject of the invention has been shown on an example of embodiment as a support with props set one after another, wherein FIG. 1 shows the side view of the support, FIG. 2 presents the lay-out of that support with the lengths which characterise it.

Roof bar 1 is connected to the anti-fall shield 3 by an articulated joint 11. The second end of that shield 3 is connected to the foot piece 2 via front 4 and rear 5 lemniscate connectors. The front connector 4 and the rear connector 5 are connected to the foot piece 2 by articulated joints 7, 8, 9 and 10. Props 6 rest on the foot piece 2 and support the roof bar 1. Between the wall front 12 and the foot piece 2 there is a conveyor 13 coupled with the said foot piece 2 by means of a hydraulic shifter 14. The articulated joint 11 is situated above the articulated joint 7 and moves when the props 6 are being extended, thus lifting the roof bar 1, or are being retracted, thus lowering the roof bar. During that time the articulated joint 11 moves in a field limited by two straight lines, i.e. the straight lines $Y_1 = 0.036 \times 30$ h and the straight line $y_2 = -0.1 \times 30$ h. The straight lines $y_1$ and $y_2$ have been drawn in the xy coordinate system. The x axis is parallel to the working surface 15 of the foot piece 2 and passes through the articulated joint 8 which connects the foot piece 2 to the rear lemniscate connector 5. The y axis is perpendicular to the x axis and passes through the articulated joint 7 which connects the foot piece 2 to the front lemniscate connector 4. The articulated joint 7 is situated above the x axis and the distance between the articulated joints 7 and 8 measured along the x axis is S. Lemniscate mechanism consisting of connectors 4 and 5, as well as anti-fall shield 3 have strictly determined length ratios. The h/s/height/-distance/ ratio is 1:/2.25–2.26. The ratio between the length $l_1$ of the rear lemniscate connector 5 measured between the geometrical axes of the articulated joint 8, 10 and the length $l_2$ of the front lemniscate connector 4 measured between the geometrical axes of the articulated joint 7, 8 is 1:/1.25–1.26, the ratio of the distance $l_3$ between the geometrical axes of the articulated joints 9, 10 and the square root of the sum of the squares of the h and s values is 1:/1.75 to 1.76. Depending upon the assumed working height range of the support the length $l_4$ of the anti-fall shield measured between the geometrical axes of the articulated joints 10, 11 is to be so chosen as to ensure displacement of the articulated joint 11 is a field limited by the $y_1$ and $y_2$ straight lines.

The ratios mentioned above have been so chosen that at the moment when the roof bar 1 of the support has reached the height possible position, the articulated joint 11 which connects the roof bar 1 to the anti-fall shield 3 lie on the straight line $y_1 = 0.036 \times + h$. When the roof bar 1 has been lowered to the lowest possible position, the articulated joint 11 moves downward and shifts so as to occupy a position on the straight line expressed by the equation $y_2 = -0.1 \times + h$. During that time the anti-fall shield 3 is being slightly inclined relative to the floor, but the above mentioned ratios of the lengths of the individual components of the lemniscate mechanism ensure a steep enough position of the anti-fall shield 3 relative to the floor. In consequence, the roof rocks will not act directly on the shield 3. The rock waste, that is bits of broken rock falling from the roof will act on the shield 3 only under dead weight/gravity forces/. Assumption of the afore mentioned ratios of the lengths of the lemniscate mechanism has ensured not only a steep enough position of the shield 3, but also a small enough length of the shield 3 as compared with that of the other similar shields. On the shield 3 of a small length there lies a smaller amount of rubble /bits of broken rocks/. This is the second component, apart from a steep position which leads in effect to a reduction of pressure forces acting on the support as a whole, which considerably facilitates operation of the support within the range of its small heights, that is in a thin bed.

We claim:

1. A lemniscate support comprising:

a foot piece;

a roof bar;

at least one movable prop connected between said roof bar and said foot piece so as to move said roof bar; and an anti-fall shield connected to said roof bar at a first end by a first joint and connected to said foot piece at a second end by a front connector and a rear connector having longitudinal axes which are spaced a distance ($L_3$) apart from each other along said anti-fall shield, said front connector is joined to said anti-fall shield by a second joint and joined to said foot piece at a third joint so that said second and third joints are spaced apart from one another by a length ($L_2$) along said front connector, whereas said rear connector is joined to said anti-fall shield at a fourth joint and joined to said foot piece at a fifth joint so that said fourth and fifth joints are spaced apart from one another by a length ($L_1$) along said rear connector, wherein said third joint is positioned on said foot piece so that the ratio of a vertical height (h) of said third joint, measured from a horizontal x-axis passing through said fifth joint, to the horizontal distance (s) of said fifth joint, measured from a vertical y-axis passing through said third joint, is 1:(2.25–2.26), and wherein the ratio between $L_1$ and $L_2$ is 1: (1.25 - 1.26) and the ratio between $L_3$ and the square root of the sum of the square of h and s is 1: (1.75–1.76) so that said first joint is restricted to move within an angle defined by lines $Y_1 = 0.036 \times + h$ and $Y_2 = -0.1 \times + h$.

* * * * *